US009943148B1

(12) United States Patent
You

(10) Patent No.: US 9,943,148 B1
(45) Date of Patent: Apr. 17, 2018

(54) PROTECTOR FOR RIB TIP OF UMBRELLA

(71) Applicant: Ching-Chuan You, Taipei (TW)

(72) Inventor: Ching-Chuan You, Taipei (TW)

( * ) Notice: Subject to any disclaimer, the term of this patent is extended or adjusted under 35 U.S.C. 154(b) by 0 days.

(21) Appl. No.: 15/426,071

(22) Filed: Feb. 7, 2017

(51) Int. Cl.
*A45B 25/18* (2006.01)
*A45B 25/06* (2006.01)
*A45B 25/02* (2006.01)
*A45B 25/00* (2006.01)

(52) U.S. Cl.
CPC ..... *A45B 25/18* (2013.01); *A45B 25/02* (2013.01); *A45B 25/06* (2013.01); *A45B 2025/003* (2013.01); *A45B 2025/186* (2013.01)

(58) Field of Classification Search
CPC ... A45B 25/18; A45B 25/22; A45B 2025/003; A45B 2025/186; E04H 15/64; E04H 15/322
USPC ..... 135/15, 33.2, 33.4–33.41, 33.5–33.6, 98, 135/119
See application file for complete search history.

(56) References Cited

U.S. PATENT DOCUMENTS 728,035 A * 5/1903 Sprague ..... A45B 25/18 135/33.5
1,082,645 A * 12/1913 Myers ..... A45B 15/00 135/33.41
2,017,753 A * 10/1935 Harry ..... A45B 25/18 135/33.5
2,051,750 A * 8/1936 Siers ..... A45B 25/18 135/33.2
2,171,476 A * 8/1939 Katz ..... A45B 25/18 135/33.2
2,746,469 A * 5/1956 D'Andrea ..... A45B 15/00 135/33.41
4,819,680 A * 4/1989 Beavers ..... E04H 15/48 135/119
5,890,506 A * 4/1999 Kupferman ..... A45B 25/22 135/33.2
7,913,709 B2 * 3/2011 Brebner ..... A45B 19/06 135/31
9,516,934 B2 * 12/2016 Frost ..... A45B 25/18
9,578,813 B2 * 2/2017 Dingwerth ..... E04H 15/28
2004/0226592 A1 * 11/2004 Nipke ..... A45B 3/04 135/33.4
2009/0056774 A1 * 3/2009 Lee ..... A45B 25/02 135/15.1

* cited by examiner

*Primary Examiner* — Winnie Yip

(57) ABSTRACT

An umbrella is provided with a frame including a shank, a handle at a lower end of the shank, a grommet at an upper end of the shank, a runner slidably disposed on the shank between the handle and the grommet, ribs radially extending from the grommet, and stretchers having two ends pivotably secured to the runner and an intermediate portion of the rib respectively; and a canopy assembly including a canopy secured in covering relation on the ribs, protection members each secured to an edge portion of an inner surface of the canopy adjacent to a tip of each rib, and rib tip protection elements each secured to both the protection member and the inner surface of the canopy. Each rib has an end releasably inserted into the rib tip protection element.

3 Claims, 7 Drawing Sheets

PROTECTOR FOR RIB TIP OF UMBRELLA

BACKGROUND OF THE INVENTION

1. Field of the Invention

The invention relates to umbrellas and more particularly to a protector for the tip of each rib of umbrella.

2. Description of Related Art

An umbrella is a folding canopy supported by metal ribs. The umbrella is usually mounted on a shank. The umbrella is designed to protect a person against rain.

It is not unusually that tips of ribs of an umbrella may hurt the body parts (e.g., the eyes) of other people by poking if sufficient care is not taken.

For eliminating above drawback, patents regarding protector for rib tip of umbrella are disclosed. For example, Chinese Utility Model number ZL200720193523.8 discloses a protector for the tip of each rib of an umbrella. The characteristics of the Utility Model are described below. A pocket 9 is formed on a canopy 3 at the tip of each rib. A shock absorbing member 8 consisting of two V-shaped resilient elements is provided in the pocket 9. Thus, the sharp ends of the ribs are protected by the pockets 9.

However, the pockets 9 of the Utility Model may be broken after a period of time of use because the V-shaped resilient elements are strong. Thus, the need for improvement still exists.

SUMMARY OF THE INVENTION

It is therefore one object of the invention to provide a protector for the tip of each of an umbrella so that the body parts of other people are prevented from being hurt by the sharp tips of the ribs when the umbrella is open.

For achieving above and other objects, the invention provides an umbrella comprising a frame including a shank, a handle at a lower end of the shank, a grommet at an upper end of the shank, a runner slidably disposed on the shank between the handle and the grommet, a plurality of ribs radially extending from the grommet, and a plurality of stretchers having two ends pivotably secured to the runner and an intermediate portion of the rib respectively; and a canopy assembly including a canopy secured in covering relation on the ribs, a plurality of protection members each secured to an edge portion of an inner surface of the canopy adjacent to a tip of each rib, and a plurality of rib tip protection elements having an opening, each secured to the protection member except the opening portion in order to enhance the supporting of the rib tip protection elements, wherein each rib has an end releasably inserted through the opening into the rib tip protection element According to an embodiment of the present invention, each rib tip protection element further includes a canopy member and a backing, the backing of each rib tip protection element is same size as the canopy member of each rib tip protection element.

According to an embodiment of the present invention, each protection member further includes a canopy element and a backing, shaped as a fan with each rib passing a radial line of the protection member.

According to an embodiment of the present invention, a lower edge of each rib tip protection element is secured to an inner surface edge of the canopy.

According to an embodiment of the present invention, each protection members is secured to an edge portion of an inner surface of the canopy adjacent to a tip of each rib.

According to an embodiment of the present invention, the canopy member of each rib tip protection element is made of flexible plastic fabric, and the backing of each rib tip protection element is nylon or fabric.

According to an embodiment of the present invention, each protection member further includes a canopy element and a backing, shaped as a fan with each rib passing a radial line of the protection member.

According to an embodiment of the present invention, the backing of each protection member is nylon or fabric, and the canopy element of protection member is made of flexible plastic fabric.

According to an embodiment of the present invention, further comprising at least one strip formed on the canopy.

According to an embodiment of the present invention, the canopy includes a lower canopy secured in covering relation on the ribs, and an upper canopy secured in covering relation to both the ribs and the lower canopy, and further comprising a plurality of vent openings each formed between a lower edge of the upper canopy and the lower canopy, the vent openings configured to open to release wind to the atmosphere.

The invention has the following advantageous effects: The sharp tips of the ribs are concealed so that the body parts of other people are prevented from being hurt by the sharp tips of the ribs when the umbrella is open.

The above and other objects, features and advantages of the invention will become apparent from the following detailed description taken with the accompanying drawings.

DETAILED DESCRIPTION OF THE INVENTION

Figure 1:
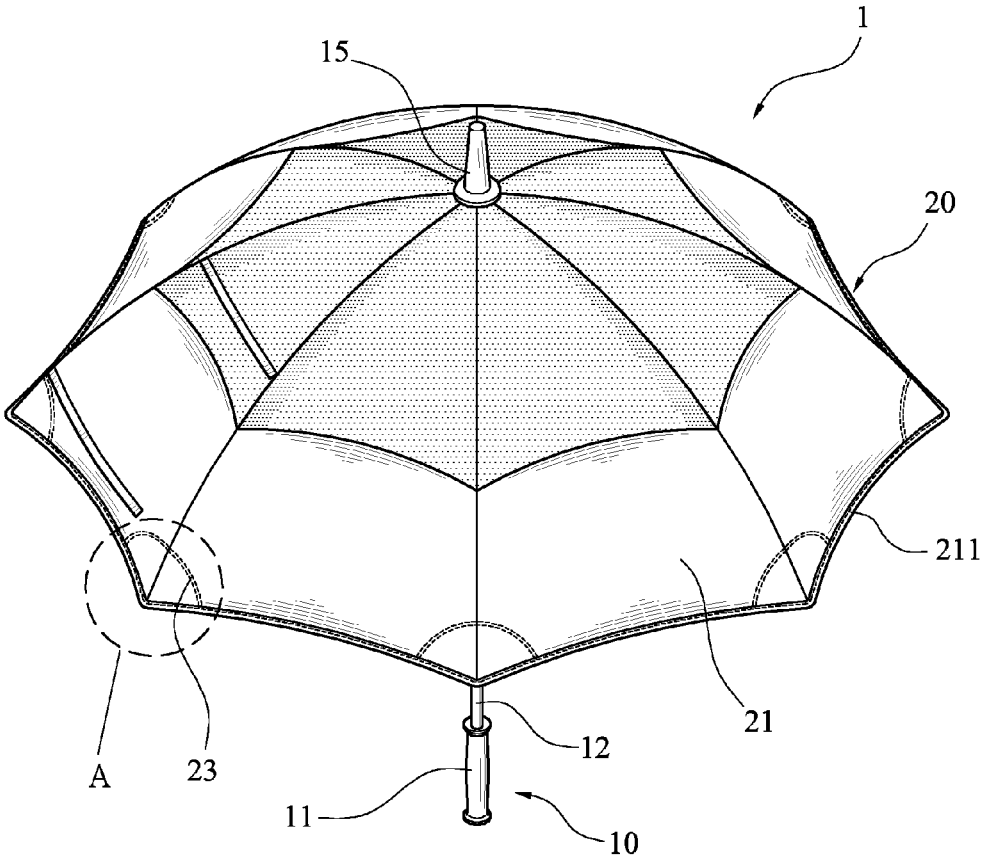
FIG. 1 is a perspective view of an umbrella having rib tips each incorporating a protector according to a first preferred embodiment of the invention.
Figure 1A:
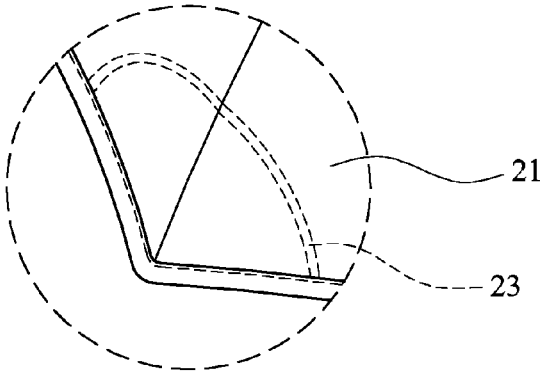
FIG. 1A is a detailed view of the area in circle A of FIG. 1.
Figure 2:
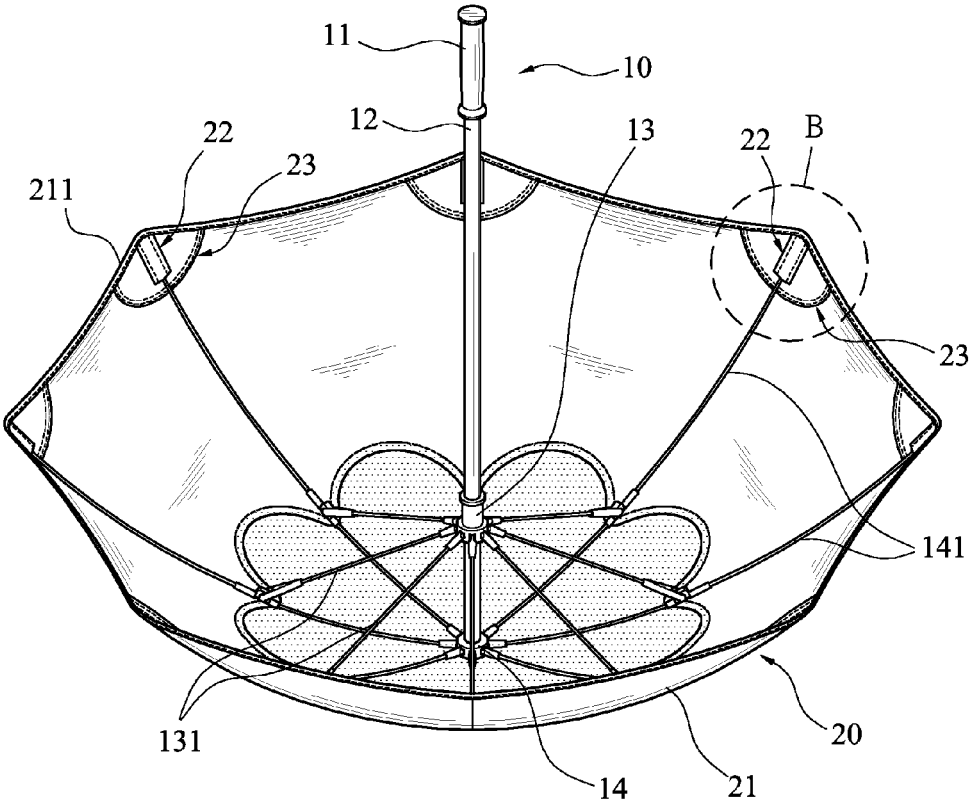
FIG. 2 is another perspective view of FIG. 1 but viewing from the bottom.
Figure 2A:
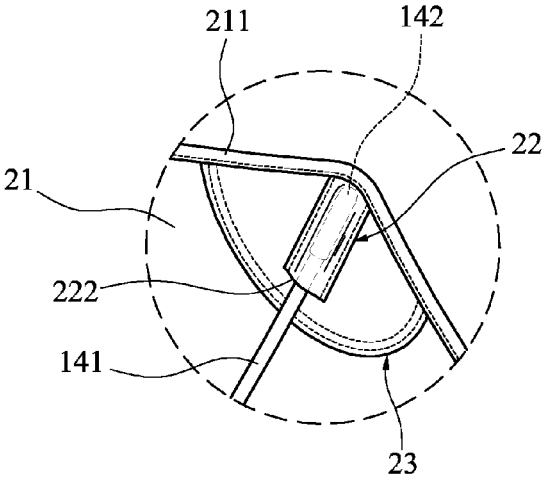
FIG. 2A is a detailed view of the area in circle B of FIG. 2.
Figure 3:
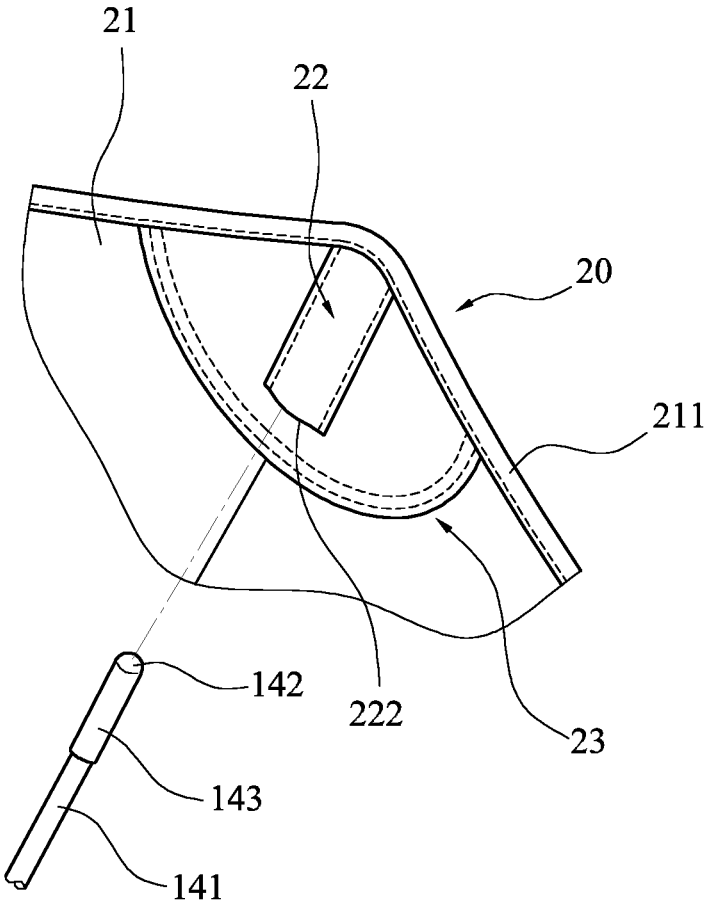
FIG. 3 is an exploded view of FIG. 2A.

Referring to FIGS. 1 to 5, an umbrella 1 according to a first preferred embodiment of the invention is shown.

The umbrella 1 comprises a frame 10 including a shank 12, a handle 11 at a lower end of the shank 12, a grommet 14 at an upper end of the shank 12, a runner 13 slidably disposed on the shank 12 between the handle 11 and the grommet 14, a plurality of ribs 141 radially extending from the grommet 14, and a plurality of stretchers 131 having two ends pivotably secured to the runner 13 and an intermediate portion of the rib 141 respectively; and a canopy assembly 20 including a canopy 21 secured in covering relation on the ribs 141 and having an edge 211, a plurality of protection members 23 each secured to an edge portion of an inner surface of the canopy 21 adjacent to the tip of each rib 141 by stitching or by sticking, and a plurality of rib tip protection elements 22 each further secured to its corresponding protection member 23 by stitching or by sticking.

The rib tip protection elements 22 forms an opening 222 at one side, and the edge portion of the rib tip protection elements 22, except for the opening 222, is secured to the protection member 23 in order to enhance the supporting of the rib tip protection elements 22. Then, the opening 222 is relatively placed at the higher edge of each protection element 22 in opening situation, and the lower edge of each protection element 22 is secured to an inner surface edge of the canopy.

The rib 141 has an open end portion 143 with a half-spherical tip 142. The end portion 143 is releasably inserted through the opening 222 getting into the rib tip protection element 22 in an assembled state. It is envisaged that the end portion 143 of the rib 141 is covered and protected by both the smaller rib tip protection element 22 and the larger protection member 23. The protection member 23 is shaped as a fan. The rib tip protection element 22 is shaped as a rectangle.

Figure 4:
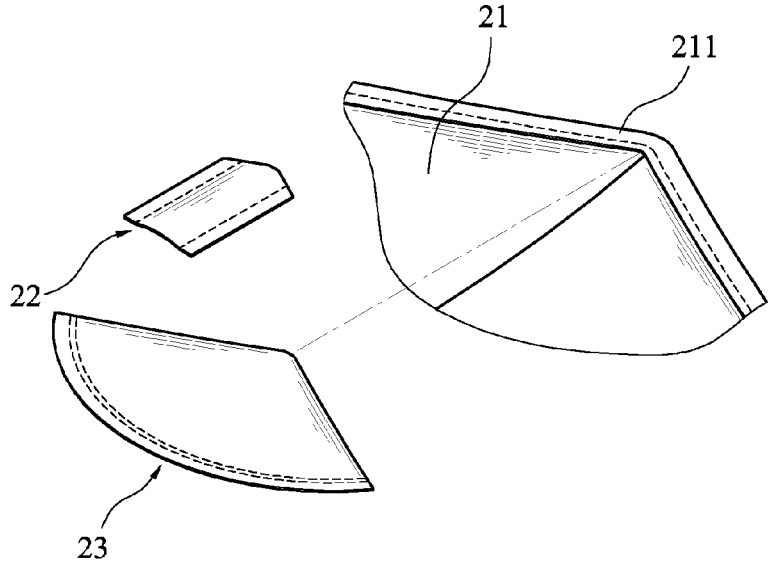
FIG. 4 is an exploded view of the rib tip protection element.
Figure 4A:
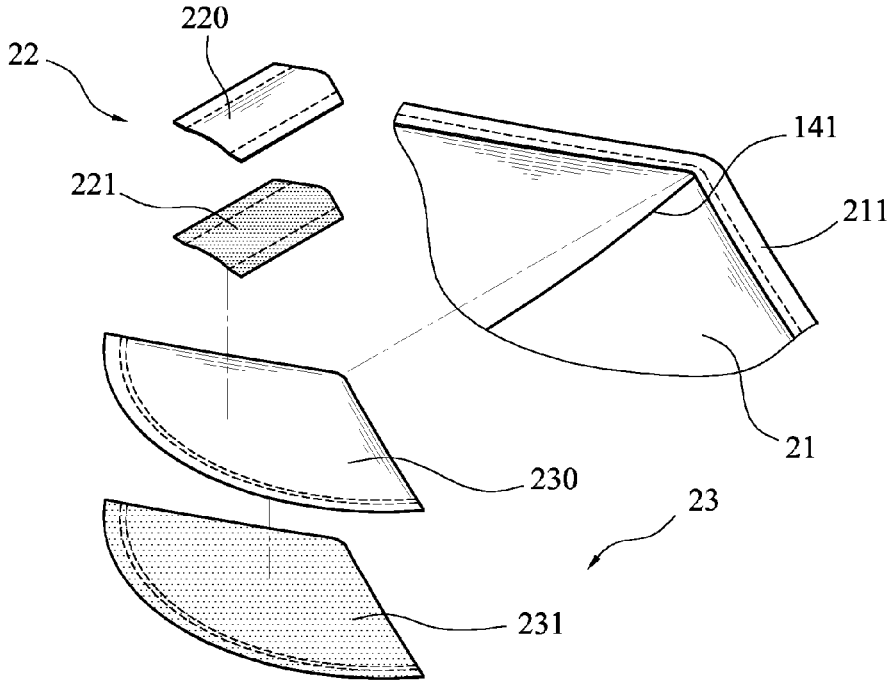
FIG. 4A is an exploded view of another configuration of the rib tip protection element.

As shown in FIG. 4A, in another configuration the rib tip protection element 22 further comprises a canopy member 220 and a backing 221 same size as the canopy member 220, and the protection member 23 further comprises a canopy element 230 and a backing 231.

The canopy element 230 is made of flexible plastic fabric. The canopy member 220 is made of flexible plastic fabric. The backing 231 is nylon or fabric. The backing 221 is nylon or fabric.

Figure 5:
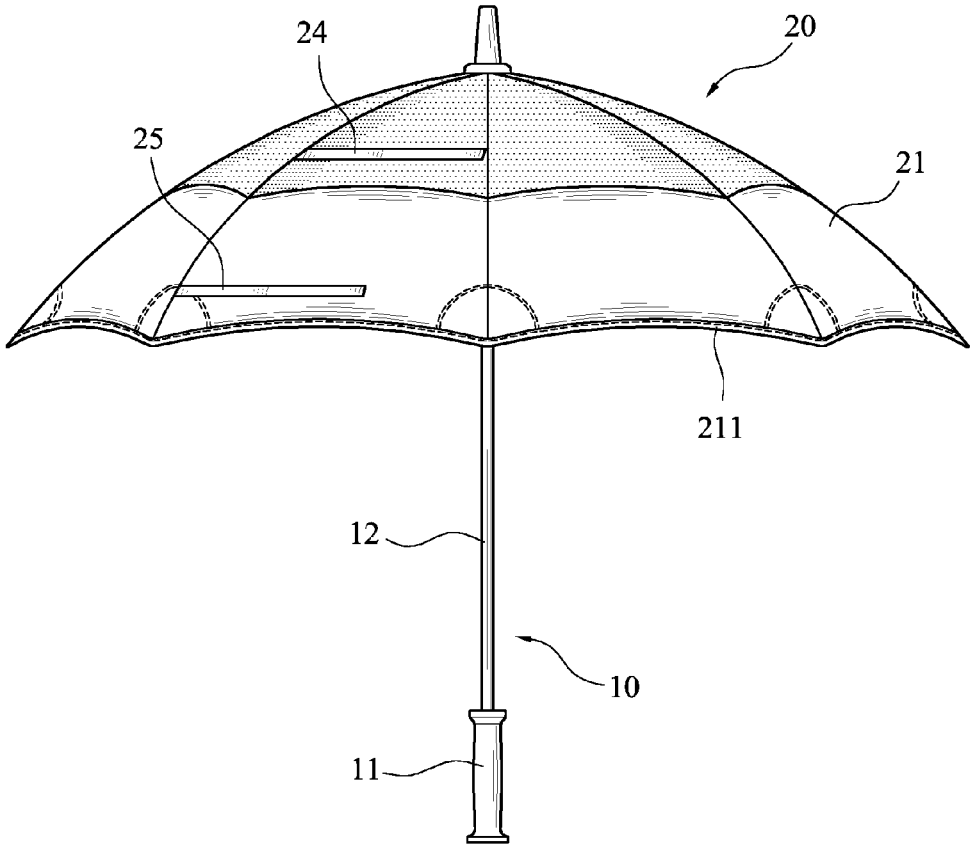
FIG. 5 is a side elevation of the umbrella showing the strips.

As shown in FIG. 5, two strips (e.g., hook and loop closures) 24, 25 are formed on the canopy 21 for ease of fastening the closed umbrella 1 in a storage or unused state.

Figure 6:
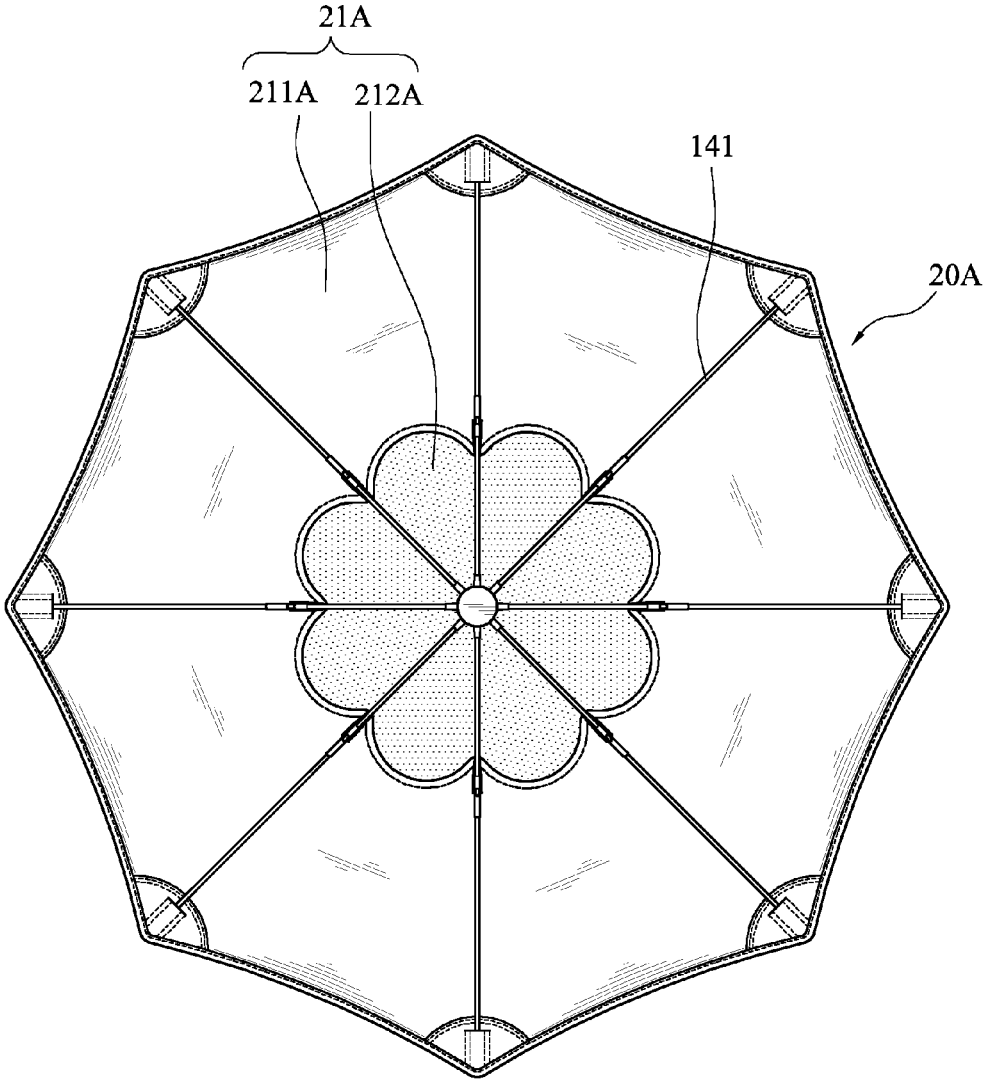
FIG. 6 is a top-bottom view of an umbrella having rib tips each incorporating a protector according to a second preferred embodiment of the invention.
Figure 7:
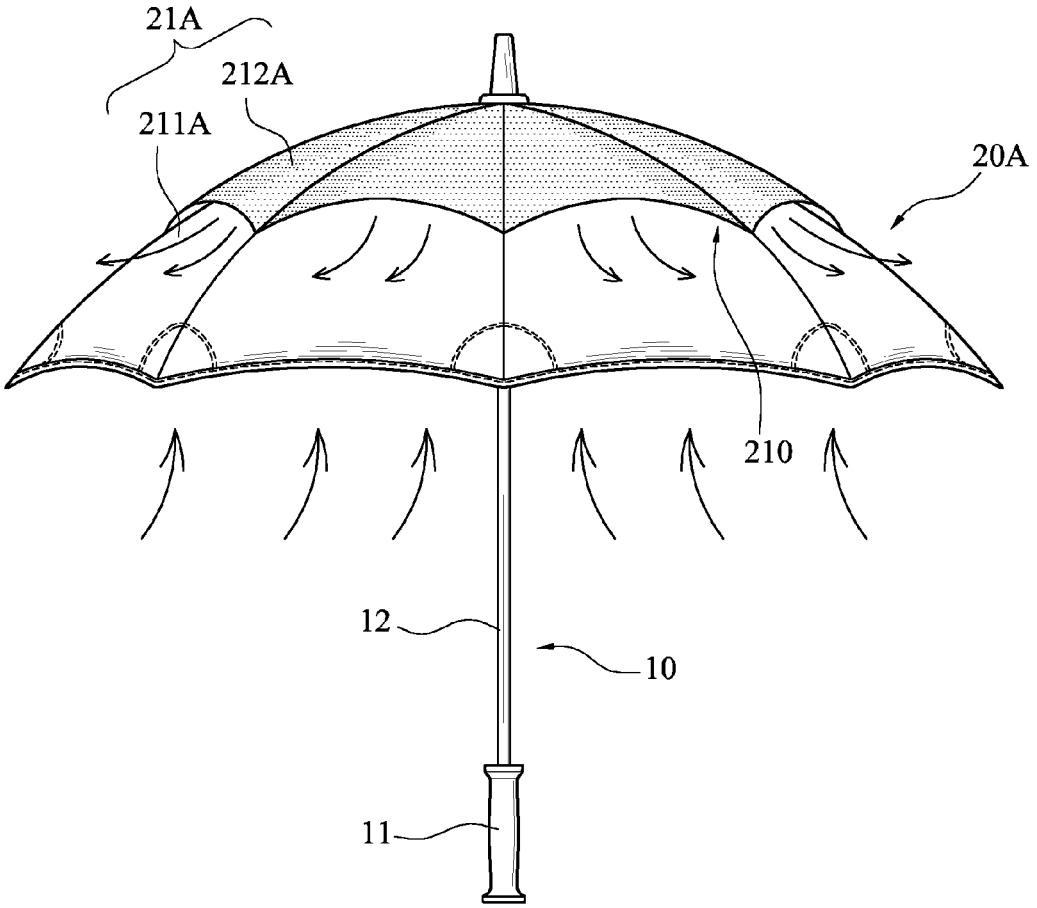
FIG. 7 is a side elevation of FIG. 6.

Referring to FIGS. 6 and 7, an umbrella according to a second preferred embodiment of the invention is shown. The characteristics of the second preferred embodiment are substantially the same as that of the first preferred embodiment except the following:

The canopy assembly 20A has a canopy 21A. The canopy 21A includes a lower canopy 211A secured in covering relation on the ribs 141, and an upper canopy 212A secured in covering relation to both the ribs 141 and the lower canopy 211A. A plurality of vent openings 210 are each formed between a lower edge of the upper canopy 212A and an upper edge of the lower canopy 211A.

The vent openings 210 are closed in a no wind condition. The vent openings 210 are open when strong wind flows upward from under the umbrella. And in turn, a plurality of escape paths for wind passing through the vent openings 210 are formed respectively. In brief, the umbrella is a windproof umbrella.

While the invention has been described in terms of preferred embodiments, those skilled in the art will recognize that the invention can be practiced with modifications within the spirit and scope of the appended claims.

What is claimed is:

1. An umbrella comprising a frame including a shank, a handle at a lower end of the shank, a grommet at an upper end of the shank, a runner slidably disposed on the shank between the handle and the grommet, a plurality of ribs radially extending from the grommet, and a plurality of stretchers having two ends pivotably secured to the runner and an intermediate portion of the rib respectively; and a canopy assembly including a canopy secured in covering relation on the ribs, a plurality of protection members each secured to an edge portion of an inner surface of the canopy adjacent to a tip of each rib, and a plurality of rib tip protection elements having an opening, each secured to the protection member except the opening portion in order to enhance the supporting of the rib tip protection elements, wherein each rib has an end releasably inserted through the opening into the rib tip protection element, wherein each rib tip protection element further includes a canopy member and a backing, the backing of each rib tip protection element is same size as the canopy member of each rib tip protection element.

2. An umbrella comprising a frame including a shank, a handle at a lower end of the shank, a grommet at an upper end of the shank, a runner slidably disposed on the shank between the handle and the grommet, a plurality of ribs radially extending from the grommet, and a plurality of stretchers having two ends pivotably secured to the runner and an intermediate portion of the rib respectively; and a canopy assembly including a canopy secured in covering relation on the ribs, a plurality of protection members each secured to an edge portion of an inner surface of the canopy adjacent to a tip of each rib, and a plurality of rib tip protection elements having an opening, each secured to the protection member except the opening portion in order to enhance the supporting of the rib tip protection elements, wherein each rib has an end releasably inserted through the opening into the rib tip protection element, wherein a lower edge of each rib tip protection element is secured to an inner surface edge of the canopy, and wherein each rib tip protection element further includes a canopy member and a backing, the backing of each rib tip protection element is same size as the canopy member of each rib tip protection element.

3. The umbrella of claim 2, wherein the canopy member of each rib tip protection element is made of flexible plastic fabric, and the backing of each rib tip protection element is nylon or fabric.

* * * * *